United States Patent [19]

Emi et al.

[11] 4,102,033

[45] Jul. 25, 1978

[54] METHOD OF PRODUCING LAYER-LIKE CLAD METAL MATERIALS

[75] Inventors: Toshihiko Emi; Masashi Kawana, both of Chiba; Katsuo Kinoshita, Narashino; Shinichiro Adachi, Chiba, all of Japan

[73] Assignee: Kawasaki Steel Corporation, Kobe, Japan

[21] Appl. No.: 779,464

[22] Filed: Mar. 21, 1977

[51] Int. Cl.[2] ..... B22D 7/02

[52] U.S. Cl. ..... 29/527.3; 164/75; 164/100; 29/527.7

[58] Field of Search ..... 29/527.3, 527.7, 527.5, 29/527.2; 164/45

[56] References Cited

U.S. PATENT DOCUMENTS 2,995,816 8/1961 Ma ..... 29/527.3 X 3,695,337 10/1972 Grand ..... 164/100

4,008,052 2/1977 Vishnevsky et al. ..... 164/75 X

*Primary Examiner*—Milton S. Mehr

[57] ABSTRACT

A method of producing layer-like clad metal materials is disclosed. The layer-like clad metal material is produced by applying an organic substance consisting mainly of carbon and hydrogen to the surface of a metallic core material having at its surface substantially no oxide film to form a coating film having a thickness of 50-3,000 μm, placing said core material in a casting mold, pouring a molten metal having the same or different composition around said core material into said mold by a bottom pouring process to form a clad metal ingot, subjecting said ingot to slab rolling or forging to form an intermediate product, and then subjecting said intermediate product to a hot working and, if necessary, a cold working.

7 Claims, 7 Drawing Figures

METHOD OF PRODUCING LAYER-LIKE CLAD METAL MATERIALS

This invention relates to a method of producing layer-like clad metal materials having a high interlaminar breaking strength and an excellent interlaminar bonding property.

The invention will now be described in detail with respect to the layer-like clad material consisting mainly of steel, but is widely applicable to the production of the other ordinary layer-like clad metal materials.

Heretofore, the clad steel plate has been produced by a method wherein at least two sheet bars (or slabs) are subjected to a surface cleaning treatment, laminated one upon the other and welded at the circumferential portion of lamination plane and then the resulting laminate is hot-rolled. In this method, however, the number of production steps is considerably large, so that the production cost becomes very high. Furthermore, the plant investment for automating the production steps becomes expensive, so that many steps rely upon a manual operation with a low productivity and hence the production capacity is considerably restricted. These drawbacks, i.e., high production cost and low productivity, are unavoidable even when the clad steel material is produced by overlay welding, explosive welding and the like.

On the other hand, there are already proposed many methods of producing the clad steel material by a casting process. For example, as shown in FIG. 1, there is a method of producing a clad metal ingot wherein a metallic core material 1 is placed in a casting mold 2 while suspending by a fixing member 6 and then a molten metal 3 having a composition different from that of the core material is poured into the mold through a runner 5 to enshroud the core material. In this figure, numeral 4 is a stool.

However, according to this method, the surface of the core material is heated by radiant heat emitted from the poured melt before the core material comes into contact with the melt and oxidized by oxygen existent in the atmosphere inside the mold. As a result, the formed oxide film lies between the core material and the solidified metal layer, so that the bonding property of the core material to the metal layer is deteriorated. Further, endogenic and/or exogenic inclusions in the melt form scums adhering to the interface between the meniscus of the melt and the core material during pouring, so that the bonding property is inevitably deteriorated.

Accordingly, in the conventional method of producing the clad metal material, there are adopted, for example, the following procedures for preventing the deterioration of the bonding property:

(A) The interior of the mold is held in a non-oxidizing atmosphere by the introduction of argon gas.

(B) Aluminum is plated or sprayed on the surface of the core material.

(C) The surface of the core material is coated with a substance capable of generating a non-oxidizing gas by heating.

According to procedure (A), however, the equipment required gets complicated and expensive in order to completely prevent the formation of oxide film on the surface of the core material. Also, the workability for procedure (A) is poor. Furthermore, procedure (A) does not serve to remove scums entrapped near the boundary between the meniscus of the melt and the core material. According to procedure (B), the cost required for plating or spraying is additional and also the removal of scums cannot be accomplished like procedure (A). According to procedure (C), it is very difficult to retain some fraction of the coating substance on a position of the core material until the meniscus of the melt comes very close to that position since the coating is usually very thin and easily vaporizes or undergoes combustion upon heating by the uprising meniscus. This makes the removal of the scums insufficient and as the case may be, the oxide film is formed on the surface of the core material.

Particularly, the top pouring process tends to become more conspicuous in the entrapment of scums as compared with the bottom pouring process even if the above mentioned procedures (A)–(C) are adopted. As a result, the bottom pouring process is generally adopted, but in this case the above mentioned drawbacks cannot be avoided. Therefore, there has not yet been known a method of steadily and cheaply producing clad metal materials with a good workability.

An object of the invention is to provide a method of steadily and cheaply producing a clad metal material wherein a clad metal ingot having a good bonding property at the interface between the core material and the solidified metal layer is prepared and then worked to form the clad metal material having less defects caused by the working.

The inventors have found out that the deterioration of the bonding property of the clad metal material due to the adhesion of scrums and formation of oxide film can be prevented at the interface between the core material and the solidified metal layer by applying one or more of organic substances consisting mainly of carbon and hydrogen, such as synthetic resins, drying oils, and the like to the surface of the core material to be placed in the mold to form a coating film having a certain thickness and as a result, the invention has been accomplished.

The invention will now be described in greater detail with reference to the accompanying drawings, wherein.

Figure 1:
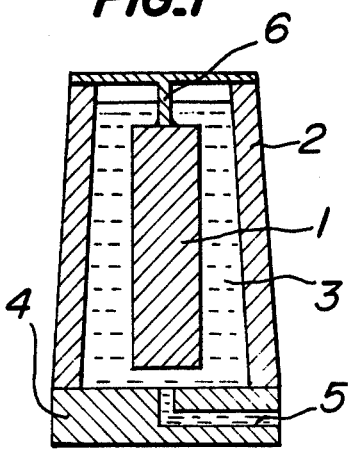
PRIOR ART FIG. 1
FIG. 1 is a schematically sectional side illustration in the cast state of the enshrouded clad metal ingot.

The method of the invention will be described in greater detail below:

According to the invention, if an oxide film is existent on a surface of a steel core material, it is necessary to previously remove such oxide film by shot blasting, cutting, grinding, pickling and the like for improving the bonding property of the clad metal ingot to be formed at subsequent step. Furthermore, the bonding property may be improved by providing parallel square grooves, triangular grooves, round grooves or other unevenness on the surface of the core material after the removal of the oxide film to increase the contact area with the melt.

Then, an organic substance consisting mainly of carbon and hydrogen is applied to the surface of the core material to form a coating film having a thickness of 50–3,000 μm, preferably 100–3,000 μm. The reason why the coating film is formed on the surface of the core material is as follows: If the core material having no coating film is placed in a casting mold at the suspended state and then molten metal is poured into the mold by the bottom pouring process, the surface of the core material is heated by radiant heat emitted from the meniscus of the melt and thermal conduction at the contact portion between the melt and the core material and easily oxidized with oxygen present in the atmosphere inside the mold to form an oxide film, so that the effect of removing the oxide film from the surface of the core material prior to pouring is lost. On the other hand, when the core material with the coating film is used and the molten metal is poured by bottom pouring process, the coating film is vaporized and/or decomposed by heating to generate a great amount of gas. As the result of such violent gasification, the scums floating on the surface of the melt are blown off at the interface between the core material and the melt surface so as not to be entrapped in the interface. At the same time, the generated gas sweeps away oxygen gas from the mold or reacts with the oxygen existing or penetrating in the mold to reduce the partial oxygen pressure of the atmosphere inside the mold, so that the formation of oxide film at the interface can be prevented.

Moreover, in order to considerably mitigate the entrapment of scums and sufficiently reduce the partial oxygen pressure inside the mold, the amount of the organic substance required for gasification should be ensured by thickening the coating film to a certain extent. In this connection, it has been confirmed from experimental results that the thickness of the coating film must be within a range of 50–3,000 μm, preferably 100–3,000 μm. When the thickness of the coating film is less than 50 μm, the coating film vaporizes or undergoes combustion to be lost before the melt comes close to or into contact with the core material and also the amount of gas generated is little, so that the oxide film and scums are entrapped in the clad ingot after cast and hence the bonding property at the interface between the core material and the enshrouding metal is deteriorated. While, when the thickness exceeds 3,000 μm, the bonding property remains unchanged and the amount of the organic substance used as the coating agent becomes economically wasteful. Therefore, it is essential that the thickness of the coating film is within a range of 50–3,000 μm, preferably 100–3,000 μm. Moreover, in order to maintain the atmosphere inside the mold at a sufficiently low oxygen partial pressure, it is desirable to decrease the oxygen content of the coating film as low as possible, so that the use of carbohydrates such as molasses and the like is unsuitable as the organic substance.

In the formation of the coating film, it is necessary that the organic substance consisting mainly of carbon and hydrogen is dissolved in a solvent to provide proper viscosity and adherence, if necessary, and applied to the surface of the core material by coating, spraying, dipping or the like and then left to stand at room temperature or heated at an appropriate temperature to form a solid or semi-solid coating film having a thickness of the above defined range.

Furthermore, the coating film can be formed by mixing the organic substance with powdery granules of a substance having an affinity for oxygen, which is stronger than that of iron, such as Al, Mg, CaSi, Si, Ti, Zr, Mg-Al alloy, Ca-Si-Al alloy, Ca-Si-Ba-Al alloy, Fe-Si alloy, Fe-Si-Mg alloy, Fe-Si-Ca alloy, Fe-Si-Al alloy, Fe-Ti alloy and the like. In this case, as seen from the following examples, the bonding property at the interface between the core material and the solidified metal layer may be improved as compared with the case of using the organic substance alone, because it is considered that scums containing a large amount of FeO accidentally entrapped in the interface are reduced by the interaction of the organic substance with the additive to change the morphology and composition of the inclusion.

According to the invention, one or more of synthetic resins and drying oils are used as the organic substance consisting mainly of carbon and hydrogen. The drying oil is an oil capable of forming a resinous solid by absorption of oxygen upon exposure to air and includes, for example, a linseed oil, a tung oil and the like. As the synthetic resin, use may be made of phenolic resin, amino resin, epoxy resin, polyamide rein, acrylic resin, melamine resin, polyester resin, vinyl resin and the like. These organic substances may be used in a combination of two or more substances. Especially, the use of the synthetic resin is advantageous because the viscosity and adherence can easily be regulated with a solvent and the solidification rate can be increased so that the thickness of the coating film can be adjusted and easily made larger. There are various methods for applying the organic substance, for example, a method of spraying the organic substance through a spray gun, a method of applying the organic substance with a brush, a method of dipping the core material in the solution of the organic substance and the like. In any case, the function of the coating film remains unchanged as far as the thickness is the same. In general, the coating film is apt to be exfoliated from the core material by subjecting to mechanical shock when the core material is placed in the mold. According to the invention, however, the exfoliation of the coating film is prevented owing to its high mechanical strength and excellent adhesion to the core material. Furthermore, the coating film made from the synthetic resin is thermostable. For example, the coating film made from the epoxy resin is stable up to about 120° C, so that there is not a fear that the coating film vaporizes or undergoes combustion and lost from the surface of the core material when the core material is heated during pouring and before the core material is immersed in the surface of the melt and consequently the oxidation reaction and the entrapment of scums can be prevented at the surface of the core material.

According to the invention, it is preferable that air is not allowed to come into the mold during pouring. This is, the introduction of oxygen source into the mold is shut off and the partial pressure of oxygen inside the mold can be maintained at a lower level. Of course, it is advantageous that the partial pressure of oxygen inside the mold is further decreased by replacing the atmosphere inside the mold with an inert or reducing gas before and/or during pouring.

According to the invention, the layer-like clad metal material can be produced with a good bonding property at the interface between the core material and the enshrouding metal without causing the decrease of product yields due to incomplete bonding after rolling and deviation of a ratio of the thickness of the core material to the thickness of the enshrouding metal (clad ratio) by defining the position of the core material in the mold and the height of the poured melt.

The interface between the core material and the solidified enshrouding metal layer may locally be welded when the superheat of the melt and the contact of the core material with the stream of the molten steel satisfy the particular requirements. In general, however, most of the interface is not welded in the clad metal ingot produced by the pouring process. If such an ingot is heated for subsequent treatment in such a state that air may penetrate into the interface between the core material and the solidified enshrouding metal layer, oxide scale is formed on the interface, so that cracks are apt to be caused at the subsequent rolling step. As a result, the product yield considerably decreases due to the interlaminar separation arising at incomplete bonding.

In fact, the inventors have confirmed that the interface between the core material and the enshrouding metal layer is not welded even in the clad steel ingot obtained by covering the circumference of the steel core material with the molten metal according to microscope investigation of its cut section.

In the production of the clad metal ingot by the bottom pouring process, if the bottom surface of the core material is considerably close to the sprue of the runner, that portion of the core material contacting with a stream of molten metal violently poured through the sprue is locally dissolved, so that the predetermined clad ratio is deviated due to such dissolving loss and hence the product yield considerably decreases.

Accordingly, there has strongly been demanded to solve the decrease of product yield due to the above mentioned two causes in order to steadily produce the layer-like clad metal material.

According to the invention, it has been found that the product yield of the final clad metal material can be improved by locating the lower end of the core material at a position of 5–30 cm apart from a given position corresponding to the bottom of the clad metal ingot in the mold, i.e. at a position of 5–30 cm above the bottom surface of the mold and pouring the molten metal up to a height of at least 5 cm above the upper end of the core material.

Figure 2A:
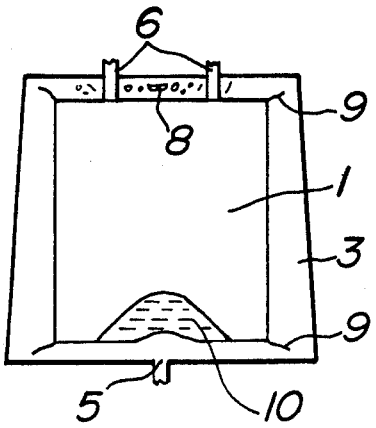
PRIOR ART FIG. 2A
FIGS. 2A and 2B are elevational and side views of the sectioned enshrouded clad metal ingot obtained by the method shown in FIG. 1, respectively.
Figure 2B:
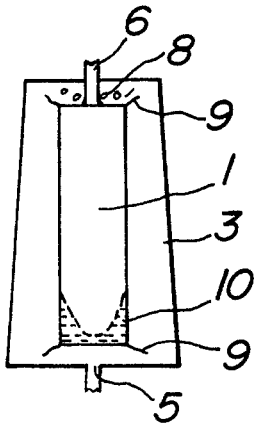
PRIOR ART FIG. 2B

As shown in FIGS. 2A and 2B, in the clad metal ingot, head shrinkage holes 8 are usually formed in the solidified layer 3 of the enshrounding metal located above the upper end of the core material 1. Furthermore, cracks 9 are often observed in the solidified layer contacting with the corners of the core material. Moreover, the dissolved portion 10 is formed in the bottom of the core material approaching to the sprue of the runner 5. If the distance between the final melt surface and the upper end of the core material is shorter, the head shrinkage holes 8 and/or cracks 9 pass through the solidified layer to provide route for air to penetrate to core material, so that the interface between the core material and the solidified layer is oxidized by the air and as a result, contact bonding is not achieved at the subsequent rolling step and the interlaminar separation may result in. On the other hand, if the distance between the final melt surface and the upper end of the core material is too long, the cut-off portion of the final product considerably increases and the product yield decreases. From these facts, the distance should be not less than 5 cm and the best result is obtained when the distance is within a range of 10–30 cm. Furthermore, a riser may be provided in order to prevent the head shrinkage hole depending upon the kind of the melt or the pouring conditions and in this case, a better result can be obtained when the melt is poured up to a riser gate. In any case, when the distance between the final melt surface and the upper end of the core material is less than 5 cm, it is difficult to completely prevent the oxidation of the interface between the core material and the solidified layer.

There is a possibility that the core material 1 is oxidized near that portion jointed with the fixing member 6 by the air penetrating from the interface between the fixing member 6 and the solidified layer 3, but the cross-sectional area of that portion is considerably smaller than that of the core material, so that the depth of the air penetration is shallow and hence the separation defect of the product due to oxidation is less.

Furthermore, according to the invention, the distance between the lower end of the core material located in the mold and the upper surface of the stool, i.e., the length of the solidified enshrounding metal layer from the lower end of the core material should be within a range of 5–30 cm. When the length is shorter than 5 cm, the cracks 9 are formed in the solidified layer to let air penetrating to the core material, so that the interface between the core material and the solidified layer is oxidized. Also, the dissolved portion 10 becomes larger, so that the product yield lowers due to the deviation of clad ratio. While, when the length is longer than 30 cm, the cut-off portion of the product increases, so that the product yield decreases.

In the pouring of the molten metal, the pouring temperature must be controlled. That is, the pouring temperature of the melt is not only an important factor for controlling an internal and surface quality of conventional ingot but also much more an important factor influencing special phenomena arising in the production of the clad metal ingot, which are not caused in the production of the conventional ingots, for example, the interlaminar bonding property of the clad metal ingot, the deviation of clad ratio due to the dissolved portion formed in the core material, cracks formed in the solidified layer from the interface with the core material, and the like.

Pouring temperature of the melt is generally controlled in terms of the superheat with reference to the liquidus temperature of the melt in the ladle prior to the pouring. In the production of the clad metal ingot, however, the pouring temperature of the melt is related to the superheat, the difference between the pouring temperature and the liquidus temperature of the melt, and to the melting temperature of the core material.

When the degree of the superheat of the melt is high with respect to the melting temperature of the core material, the dissolution of the core material is caused and particularly that portion contacting with the pouring stream is considerably dissolved. Therefore, when the core material having a size previously determined from the clad ratio is considerably dissolved, the product corresponding to the dissolved portion does not satisfy the given clad ratio, so that the product yield lowers considerably.

It has been experiencedly confirmed that the decrease of product yield due to the dissolved portion cannot be ignored when the degree of the superheat of the melt exceeds 80° C with respect to the liquidus temperature of the core material ($T_S{}^L$° C) and also the resulting ingot itself is often obliged to be disused when the degree of the superheat exceeds 100° C.

Furthermore, when the degree of the superheat of the melt is high with respect to the liquidus temperature of the melt ($T_L{}^L$° C), cracks are formed in the top portion and bottom portion of the resulting ingot and the interface between the core material and the solidified layer is oxidized by the air penetrating from the cracks at the subsequent hot working step, so that the interlaminar bonding property is considerably deteriorated. This tendency is experiencedly confirmed to be remarkable when the degree of the superheat with respect to $T_L{}^L$ exceeds 100° C.

On the other hand, when the degree of the superheat with respect to $T_L{}^L$ is small, crusts are formed on the surface of the melt, so that the good contact state between the melt and the surface of the core material is lost and at the same time the entrapment of scums increases and consequently the interlaminar bonding property lowers. It has been experiencedly confirmed that the interlaminar bonding property begins to lower when the degree of the superheat with respect to $T_L{}^L$ is less than 40° C and the lowering thereof becomes remarkable when the degree of the superheat is less than 20° C.

In order to form a dense solidified layer of the melt in the space between the core material and the mold wall and also to prevent the clogging of the space by solidifying the melt during pouring, a relation between an average space (d), a rise rate of the melt (v) and a height of ingot (H) has been found to be an important factor. That is, according to the invention, it has been found out that the clad metal ingot suitable for the layer-like clad metal material is obtained by maintaining such relation to obey the following equations when pouring the melt having a usual degree of superheat: When the rise rate (v) is $0.0125H+0.011>v\geqq 0.33$, $$d \geqq \frac{29.08H - 1{,}000v - 413}{4.154H - 106},$$

while when the rise rate is $6.67>v\geqq 0.0125H+0.011$, $d\geqq 4$. This relation is particularly advantageous to be applied to the production of the clad metal material having a low clad ratio.

When fulfilled are the above conditions for the formation of the dense solidified layer of the melt without causing the clogging, the rise rate of the melt during pouring becomes an important factor influencing the interlaminar bonding property of the resulting clad metal material.

Namely, when the rise rate is high, the surface of the melt is violently disturbed and hence there is often increased a chance wherein scums floating on the surface of the melt come into contact and are entrapped on the surface of the core material. This increasing chance counteracts the effect of preventing the entrapment of floated scums in the interface by a violent gasification reaction due to vaporization and/or thermal decomposition of the oxidation-preventing film coated on the surface of the core material. The upper limit of the rise rate is desirable to be not more than 1.8 cm/sec as seen from the following examples.

On the other hand, when the rise rate is low, the oxidation-preventing film coated on the surface of the core material is exposed to radiant heat emitted from the melt surface and subjected to conductive heat coming through the core material immersed in the melt for a long time during pouring, whereby even the film located far above the melt surface vaporizes and undergoes decomposition and combustion, so that the oxidation preventing effect of the film is not retained when the surface of the core material comes into contact with the melt surface. Further, when the rise rate is low, crusts are formed on the melt surface to degrade the contact state between the melt and the surface of the core material and to promote the entrapment of scums on the interface. Therefore, there is a lower limit of the rise rate in order to improve the interlaminar bonding property of the clad metal material. That is, the lower limit is desirable to be not less than 0.5 cm/sec as seen from the following examples.

As mentioned above, the rise rate of the melt is most preferable within a range of 0.5–1.8 cm/sec in the case of producing the dense clad metal ingot having an excellent interlaminar bonding property without causing the clogging.

In general, when the clad metal ingot is subjected to slab rolling to form a slab as an intermediate product in order to improve the interlaminar bonding property of the final product, uneven portions called as fish tail project at both ends of the slab in a rolling direction. Therefore, it is necessary to subject the both ends to cut regulation or crop cutting after the slab rolling. If cracks are existent in the cut section, the cutting must be further effected from the cut section to its internal portion. However, if the depth of crack is shallow, only the crop cutting may be effected after the slabbing because there is a chance of effecting the cutting at the subsequent rolling step.

When the clad metal ingot is slab rolled, the interface between the core material and the solidified metal layer in the slab is not necessarily fully contact bonded yet all over the interface. However, if such slab is crop-cut so as not to expose the core material to the air, the oxidation is not caused at the interface, so that it has been experiencedly found that the interlaminar bonding property of the final product obtained at subsequent steps is excellent.

When the periphery of the interface between the core material and the enshrouding metal is exposed on the cut section by excessive cut regulation or crop cutting, the incompletely bonded portion of the interface becomes into contact with the air and has an oxide scale formed on it by penetrated air through that portion, so that cracks are apt to be formed at the subsequent rolling step. If such slab is made into a final product, the reject ratio due to interlaminar separation becomes larger. Therefore, it has strongly been demanded to solve the above drawbacks in order to produce sound layer-like clad metal material.

As mentioned previously, the interface between the core material and the solidified metal layer is not always weld bonded in the clad metal ingot. Therefore, the interlaminar bonding property of the clad metal material obtained by the cladding method must be secured in the progress of pressing the ingot by the subsequent hot working step. In other words, when the periphery of the interface between the core material and the solidified metal layer is forced to appear on the cut section of slab by excessive cut regulation or crop cutting before the interlaminar bonding property is secured, the oxidation is caused at the interface in the subsequent hot working step and the desired interlaminar bonding property of the final product is not obtained.

When the core material is exposed to the air by cutting the crops of the enshrouded clad metal ingot after the slab rolling, it is mandatory to previously and completely bond the core material with the solidified metal layer. The inventors have found that the interlaminar bonding property of the final product obtained by working the enshrouded clad metal ingot is first accomplished by rendering a total reduction ratio (thickness of ingot/thickness of intermediate product) to not less than 1.5 in the slab rolling of the ingot.

Figure 3:
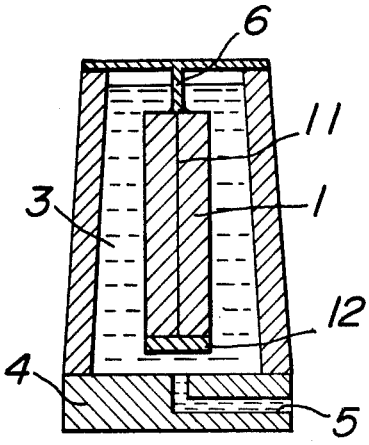
FIG. 3 is a schematically sectional side illustration in the other cast state of the enshrouded clad metal ingot.

In the case of working the conventional ingot into an intermediate product, the total reduction ratio of not less than 1.5 is relatively easily attained. In the case of the clad metal ingot, however, it is not easy to attain the same total reduction ratio in the slab rolling as in the case of the conventional ingot because of its peculiarities. For instance, in the production of two-layer clad metal material as shown in FIG. 3, the clad metal ingot is cut at both ends and both sides so as to expose the circumference of the core material at the step of forming an intermediate product and separated at the center of the thickness from each other and then the separated slabs are fed in the subsequent working step. In this case, it is necessary to maintain each slab at a given thickness and the separation operation is rendered not to be obstructed, so that the total reduction ratio of the clad metal ingot cannot be made as large as that of the conventional ingot during slab rolling. As a result, the interface between the core material and the solidified metal layer is exposed at the crop and side cutting of the ingot due to the working of relatively low reduction ratio. If the slab rolling is effected so as to ensure the total reduction ratio of not less than 1.5 and then the crop and side cutting is made till the core material is exposed, the interlaminar bonding property of the clad metal material obtained by working the intermediate product at subsequent step is considerably improved.

The following examples are given in illustration of this invention and are not intended as limitations thereof.

EXAMPLE 1

A rimming steel having a cross sectional size of 25×95 cm was used as a core material and an antioxidant shown in the following Table 1 was applied thereon as a coating agent to form a coating film having a thickness as shown in Table 1. After the core material was placed in a casting mold having a cross sectional size of 55×110 cm, a high carbon steel is poured into the mold by a bottom pouring process to form a clad metal ingot. Then, the ingot was slab rolled and further hot worked to obtain a clad sheet of 4 mm thickness. The occurrence of defect due to poor bonding at the interface between the core material and the poured melt was measured by an ultrasonic flaw detector with respect to specimens sampled from the clad sheet. The obtained results are shown in Table 1 on a basis of ingot unit.

Table 1

| | Occurrence of defects in clad sheet of 4 mm thickness by ultrasonic flaw detector (%) | | | | | | | |
|---|---|---|---|---|---|---|---|---|
| Thickness of coating film (μm) / Coating agent | 20 | 40 | 60 | 100 | 500 | 1,000 | 2,000 | 4,000 |
| Drying oil | 100 | 40 | 20 | — | — | — | — | — |
| Phenol resin | 100 | 46 | 16 | 13 | 5 | 4 | 3 | 5 |
| Amino resin | 95 | 32 | 20 | 8 | 5 | 3 | 2 | 3 |
| Epoxy resin | 80 | 39 | 19 | 5 | 3 | 1 | 2 | 2 |
| Epoxy resin + Al powder* | 81 | 30 | 16 | 3 | 1 | 2 | 1 | 3 |
| Epoxy resin + CaSi powder according to JIS No. 1* | 75 | 32 | 10 | 3 | 2 | <1 | 1 | 2 |
| Polyamide resin | 93 | 38 | 18 | 10 | 6 | 3 | 1 | 2 |
| Acrylic resin | 84 | 35 | 15 | 7 | 4 | 2 | 4 | 3 |
| Melamine resin | 95 | 37 | 17 | 6 | 4 | 3 | 3 | 2 |
| Polyester resin | 88 | 33 | 13 9 | 4 | 2 | 3 | 1 | |
| Polyester resin + Al powder* | 80 | 29 | 15 | 7 | 2 | 2 | 1 | 1 |
| Vinyl resin | 96 | 41 | 18 | 11 | 7 | 3 | 2 | 4 |
| Vinyl resin + Al powder* | 90 | 25 | 17 | 10 | 3 | <1 | 1 | 3 |
| Vinyl resin + CaSi powder according to JIS No. 1* | 85 | 31 | 15 | 7 | 3 | 2 | 2 | 2 |

*Powder content: 20–30 wt. %

As seen from the data in Table 1, when the thickness of the coating film is 20 μm or 40 μm, the occurrence of defect becomes large even if any one of antioxidants shown in Table is used as the coating agent, while the occurrence of defect in the case of 4,000 μm thickness is not significantly different from that for 2,000 μm thickness. Furthermore, the formation of the coating film having a thickness of more than 60 μm by using the drying oil must require the several repeats of the coating procedure, so that it is not attempted to form the coating film having a thickness of more than 60 μm. Moreover, it has been found that when the coating film having a thickness of 100-3,000 μm is formed by using the synthetic resin, a better result is obtained with less occurrence of defect.

When Al powder or CaSi powder according to JIS No. 1 is added as a substance having a strong affinity for oxygen to the antioxidant in an amount of 20–30% by weight, it has been found that there is a tendency of further decreasing the occurrence of defect.

EXAMPLE 2

(1) A metal member for fixing was welded to a top portion of a low carbon steel slab (C: 0.12%, Si: trace, Mn: 0.40%) having a size of 20 cm (thickness) × 100 cm (width) × 200 cm (height) as a core material and then a silver paint (consisting mainly of epoxy resin varnish and aluminum paste) was applied on the circumference of the resulting assembly to form a coating film having a thickness of about 400–800 μm. The thus obtained core material was placed in a center portion of a casting mold for ingot having a size of 55 cm (thickness) × 110 cm (width) × 230 cm (height) in such a manner that the height of the upper end of the core material was varied at five levels. Then, a melt of a high carbon steel (C: 0.63%, Si: 0.27%, Mn: 0.65%) was poured into the mold till the final level of the melt surface was positioned up to a given height from the upper end of the core material to obtain five clad metal ingots A-E as shown in the following Table 2. These ingots were slab rolled at a given total reduction ratio into slabs. After the top and bottom crops were cut at a length of 10 cm, the slabs were hot rolled to obtain strips having a thickness of 7 mm. These strips were subjected to a trimming step, a flat cut step and an inspection step. In the later step, the interlaminar separation and clad ratio were examined to obtain results shown in Table 2.

TABLE 2

| Ingot | Space between bottom surfaces of mold and core material (cm) | Height of final melt surface from upper end of core material (cm) | Total reduction ratio in slab rolling | Yield at slab rolling step (%) | Yield at hot rolling and trimming step (%) | Product yield (%) | Overall yield (%) | Remarks |
|---|---|---|---|---|---|---|---|---|
| A | 3 | 10 | 2.6 | 94 | 81 | 63 | 48 | Top and bottom crops of slab are cut at a length of 10 cm. The deviation of clad ratio is frequently caused. |
| B | 7 | 10 | 2.6 | 95 | 82 | 95 | 74 | Top and bottom crops of slab are cut at a length of 10 cm. |
| C | 10 | 4 | 2.6 | 94 | 82 | 60 | 46 | Top and bottom crops of slab are cut at a length of 10 cm. The interlaminar separation defect is frequently caused. |
| D | 10 | 7 | 2.4 | 95 | 81 | 96 | 74 | Top and bottom crops of slab are cut at a length of 10 cm. |
| E | 10 | 7 | 1.8 | 93 | 81 | 91 | 69 | " |
| F | 15 | 15 | 1.6 | 80 | 90 | 89 | 64 | Top and bottom crops of slab are cut at a length of 15 cm. |
| G | 15 | 15 | 1.45 | 79 | 91 | 53 | 38 | Top and bottom crops of slab are cut at a length of 15 cm. The interlaminar separation defect is frequently caused. |

As seen from the data in Table 2, ingot A is low in the product yield due to the deviation from the given clad ratio and ingot C is also low in the product yield due to the interlaminar separation, while ingots B, D and E give the satisfactory product yield.

(2) Two low carbon steel slabs (C: 0.12%, Si: trace, Mn: 0.40%) each having a size of 18 cm (thickness) × 100 cm (width) × 195 cm (height) were put one upon another with MgO powder as a separator and welded at the circumference and further welded at the bottom surface with a chiller composed of the low carbon steel of the same composition as shown by numeral 12 in FIG. 3 to produce a core material having a size of 36 cm (thickness) × 100 cm (width) × 200 cm (height). The thus obtained core material was treated in the same manner as described above to form two clad metal ingots F and G. These ingots were rolled into slabs. After crops of 15 cm length and both sides were cut, the slabs were separated at the center of the thickness from each other and then hot rolled to obtain strips having a thickness of 7 mm. The product yield of the strip was examined at the inspection step as described above to obtain results also shown in Table 2.

As seen from the data in Table 2, the product yield for ingot G is low due to the interlaminar separation because the total reduction ratio in the slab rolling is 1.54, while ingot F gives the satisfactory product yield because the total reduction ratio is 1.6.

EXAMPLE 3

(1) Two high carbon steel plates each having a cross sectional size of 5.5 × 200 cm were put one upon another with MgO powder as a separator and welded at the circumference and further welded at the bottom surface with a chiller composed of the carbon steel of the same composition as shown in FIG. 3 to produce a core material. Then, a paint consisting mainly of epoxy resin was applied on the whole surface of the core material to form a coating film having a thickness of 300–700 μm. After the core material was placed in a center of a casting mold having a cross sectional size of 80 × 210 cm, a melt of high tension steel was poured around the core material at various rise rates of the melt ranging 0.67–1.67 cm/sec to produce clad metal ingots. The thus obtained ingots were rolled at a total reduction ratio of 2.7 into slabs. After both ends of the slab were cut with a gas torch, the slab was separated at the center of the thickness from each other. Ingot K shown in the following Table 3 was considerably dissolved at the bottom portion of the core material including the chiller during pouring because the degree of the superheat with respect to $T_S^L$ is 110° C, so that a given clad ratio could not be achieved and also the separation of the slab could not be effected due to the penetration of the melt into the contact surface of the core material and consequently this ingot was disused. The other slabs produced from ingots H, I and J shown in Table 3 were separated and hot rolled to obtain sheet bars having a thickness of 12.7 mm.

Figure 4:
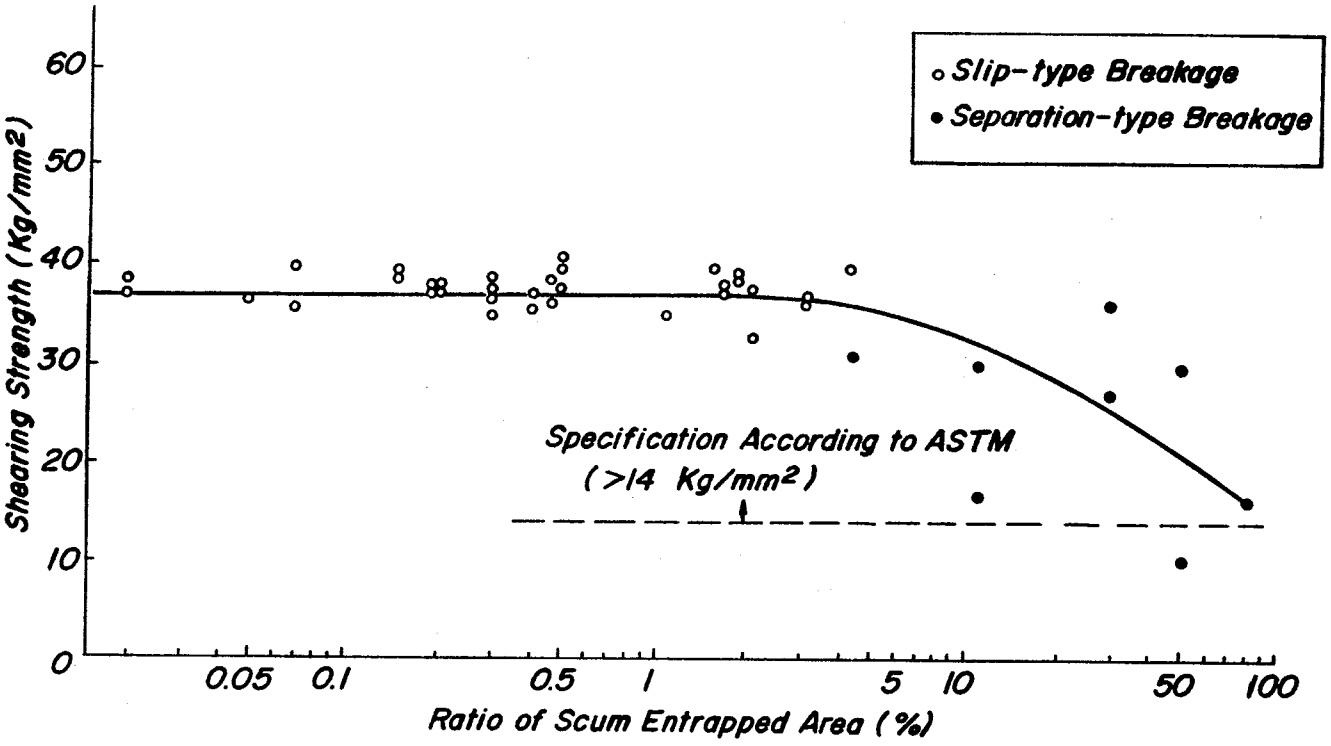
FIG. 4 is a graphical representation showing a relation between the shearing strength and the ratio of scum entrapped area in the clad sheet produced from the enshrouded clad metal ingot.

Then, the specimens sampled from these sheet bars were measured with respect to the shearing strength at breakage according to a method of ASTM A-264. Furthermore, the transversal cross section of the specimen was observed by a microscope, whereby a ratio of scum entrapped area was measured according to a lineal analysis. A relationship between the thus obtained shearing strength at breakage and the ratio of scum entrapped area is shown in FIG. 4. As seen from FIG. 4, when the ratio of scum entrapped area is not more than 5%, the shearing strength at breakage is held at more than about 30 kg/mm$^2$ and the slip-type breakage is generally exhibited. On the contrary, when the ratio of scum entrapped area exceeds 5%, the shearing strength at breakage decreases and the separation-type breakage is caused. Therefore, the sufficient interlaminar bonding property is obtained by limiting the ratio of scum entrapped area to not more than 5%.

In Table 3, there are shown mean values of the shearing strength at breakage and the ratio of scum entrapped area in the sheet bars produced from ingots H, I and J having different degrees of superheat.

Table 3

| Ingot | Rise rate of melt (m/min) | Degree of superheat with respect to $T_L^L$ (° C) | Degree of superheat with respect to $T_S^L$ (° C) | Shearing strength at breakage (kg/mm$^2$) | Ratio of scum entrapped area (%) |
|---|---|---|---|---|---|
| H | 0.8 | 16 | 58 | 25 | 15 |
| 1 | 0.5 | 35 | 77 | 34 | 4 |
| J | 0.6 | 43 | 85 | 39 | 0.3 |
| K | 0.6 | 68 | 110 | The ingot is disused due to the dissolving loss | |

(2) A core material composed of two rimming steels was placed in a casting mold and then a melt of a high tension steel was poured therein in the same manner as described above to produce a clad metal ingot. This ingot was rolled into a slab. After both ends were cut with a gas torch, the slab was separated at the center of the thickness from each other. The separated slabs were hot rolled to produce sheet bars having a thickness of 38 mm. The shearing strength at breakage and the ratio of scum entrapped area were measured with respect to the specimen of the sheet bar in the same manner as described above and as a result, it has been confirmed that the relation of FIG. 4 is also qualitatively established in this case and the shearing strength at breakage lowers with the ratio of scum entrapped area of more than 5%. In the following Table 4, there are shown mean values of the shearing strength at breakage and the raio of scum entrapped area in the sheet bars produced from ingots L, M, N and O having different degrees of superheat.

Table 4

| Ingot | Rise rate of melt (m/min) | Degree of superheat with respect to $T_L^L$ (° C) | Degree of superheat with respect to $T_S^L$ (° C) | Shearing strength at breakage (kg/mm$^2$) | Ratio of scum entrapped area (%) |
|---|---|---|---|---|---|
| L | 0.7 | 50 | 34 | 38 | 0.4 |
| M | 0.6 | 73 | 57 | 37 | 0.2 |
| N | 0.7 | 95 | 79 | 33 | 5 |
| 0 | 0.8 | 103 | 87 | 25 | 28 |

As seen from Tables 3 and 4, in order to produce a clad metal ingot having an improved interlaminar bonding property, a proper pouring temperature (T) is within a range defined by the following equation:

$$T_L^L+20 \leqq T \leqq T_X^L+100$$

wherein $T_X^L$ represents a lower value between $T_L^L$ and $T_S^L$.

EXAMPLE 4

The core material was prepared by applying a paint consisting mainly of epoxy resin to the surface of rimming steel plates having different thicknesses and heights to form a coating film having a thickness of about 300–700 μm and then placed in the center of each of three casting molds having capacities of 7 tons (height 150 cm), 9 tons (height 230 cm) and 18 tons (height 280 cm), respectively, in such a manner that an average space (d) between the mold wall and the surface of the core material is within a range of 3.5–9 cm. Then, a melt of a high carbon steel was poured at various rise rates around the core material in the mold to obtain clad metal ingots. These ingots were rolled into slabs, which were hot rolled to obtain strips having a thickness of 9 mm. The specimens were sampled from the strips on a basis of ingot unit and defects of the high carbon steel surface layer in the specimen were measured by an immersion type flaw detector to obtain results shown in FIG. 5. In this figure, symbols ○, □ and Δ show the ingots having no defect, while symbols ●, ■ and ▲ show the ingots having defects. It has been found that when inspecting the slab obtained under the same conditions as those for the production of strip having defects, the defects result fromloose structure and/or cavities caused in the enshrouding metal by insufficient feeding of the melt, and hence improper choice of the rise rate for a given set of *d* and *H*.

Figure 5:
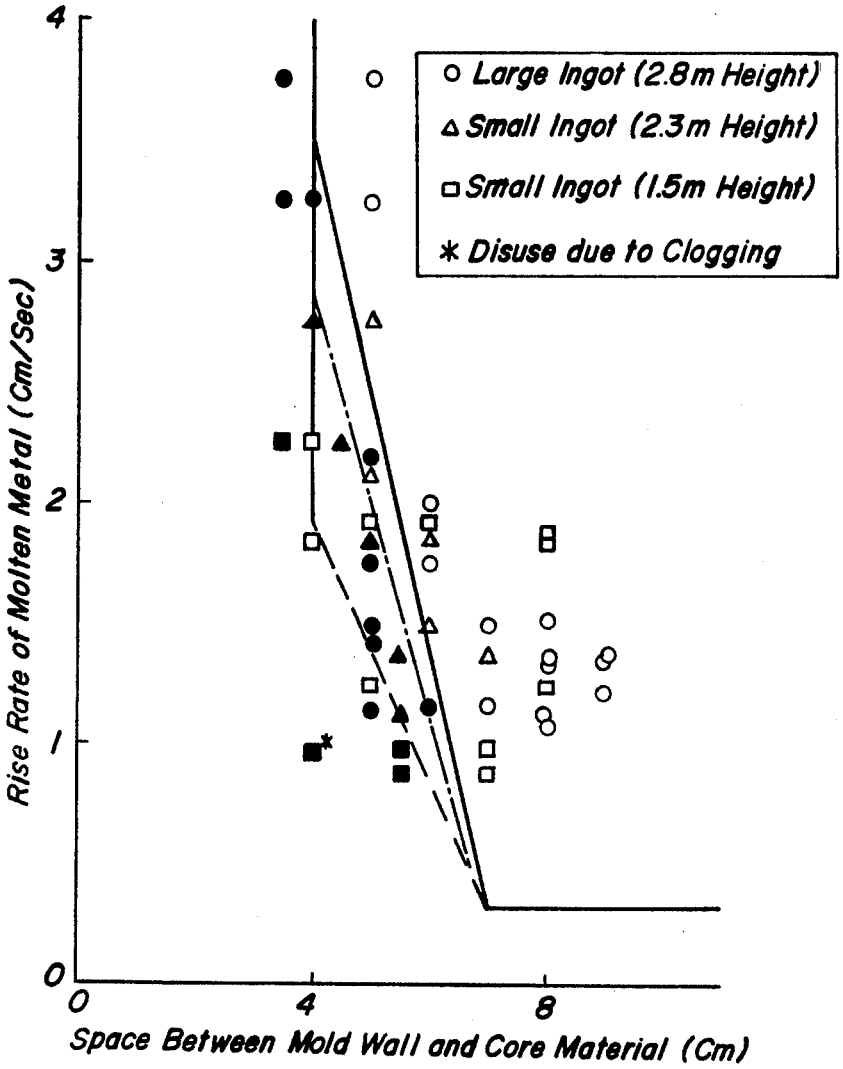
FIG. 5 is a graphical representation showing a relation between the distance from the mold wall to the surface of the core material and the rise rate of the melt, which influences the occurrence of defects in the solidified metal layer.

In order to examine whether or not the critical condition of defect generation shown in FIG. 5 is influenced by the compositions of the core material and the melt, a melt of a low carbon killed steel was poured around the core material of the high tension steel under the same condition as described above and as a result, the critical condition shown in FIG. 5 was substantially established even in this case. This critical condition can be defined by the following equation:

$$d \geqq 29.08H-1{,}000v-413/4.154H-106 \text{ in case}$$

of $0.0125H+0.011>v\geqq 0.33$, and $$d \geqq 4 \text{ in case}$$

of $6.67>v\geqq 0.0125H+0.011$, wherein *d* (cm) is a space between the mold wall and the surface of the core material, v (cm/sec) is a rise rate of the melt in the space, and H (cm) is a height of the ingot.

EXAMPLE 5

Two rimming steel plates having cross sectional sizes of 23×90 cm and 28×130 cm, respectively, were coated with a paint consisting mainly of epoxy resin to form a coating film having a thickness of 300–700 μm and then placed in two casting molds having cross sectional sizes of 60×120 cm (for the production of 9 tons ingot) and 80×150 cm (for the production of 23 tons ingot), respectively. Then, a melt of a high carbon steel was poured at a temperature of 1,540°–1,560° C by varying the rise rate of the melt to produce clad metal ingots. These clad metal ingots were slab rolled at a total reduction ratio of 3.0 and then hot rolled to obtain strips having a thickness of 7 mm.

Figure 6:
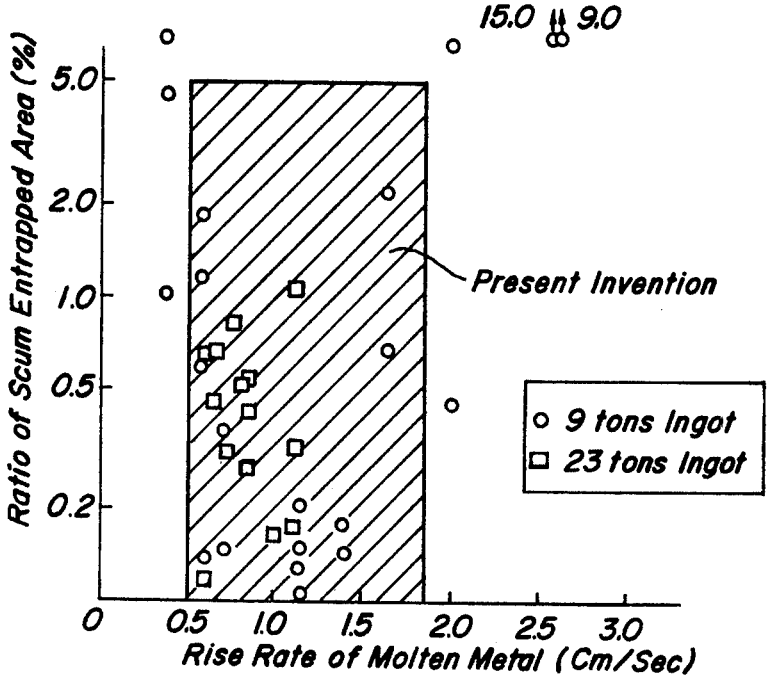
FIG. 6 is a graphical representation showing a relation between the rise rate and the ratio of scum entrapped area.

The specimens sampled from the strips were observed at their cross sections by a microscope, whereby the ratio of scum entrapped area was measured according to a lineal analysis. The change of the ratio of scum entrapped area on the rise rate is shown in FIG. 6. Moreover, the shearing strength at breakage of the strip was measured in the same manner as described in Example 3 and has been found to be substantially in qualitative agreement with the dependence in FIG. 4. From these facts, it can be seen that the shearing strength at breakage decreases when the ratio of scum entrapped area is more than 5%. Therefore, one of pouring conditions for improving the interlaminar bonding property capable of imparting a satisfactory interlaminar breaking strength is the rise rate of 0.5–1.8 cm/sec as seen from FIG. 6.

What is claimed is:

1. A method of producing layer-like clad metal materials, comprising applying at least one organic substance selected from the group consisting of phenolic resin, amino resin, epoxy resin, polyamide resin, acrylic resin, polyester resin, and vinyl acetate resin, on a surface of a metallic core material having at its surface substantially no oxide film to form a coating film having a thickness of 50-3,000 μm, fixing said core material in a casting mold, using a fixing metal member in such a manner that the lower end of the core material is located at a position of 5–30 cm above the bottom surface of the mold, pouring a molten metal having the same composition around said core material up to a height of at least 5 cm above the upper end of the core material, into said mold by a bottom pouring process to form a clad metal ingot, subjecting said ingot to slab rolling or forging to form an intermediate product, and then subjecting said intermediate product to a hot working and, if necessary, a cold working.

2. A method as claimed in claim 1, wherein said thickness of the coating film is within a range of 100–3,000 μm.

3. A method as claimed in claim 1, wherein said molten metal is poured into said mold in such a manner that the interior of the mol is shut off from the air and maintained in a non-oxidizing atmosphere.

4. A method as claimed in claim 1, wherein said molten metal is poured in such a manner that an average space (d) (cm) between the mold wall and the surface of the core material satisfies the following relations in compliance with a height (H) (cm) of the ingot and a rise rate (v) (cm/sec) of the molten metal:

$$d \geqq 29.08H\text{-}1{,}000v\text{-}413/4.154H\text{-}106 \text{ in case}$$

of $0.0125H+0.011>v\geqq 0.33$, and $$d \geqq 4 \text{ in case}$$

of $6.67>v\geqq 0.0125H+0.011$.

5. A method as claimed in claim 1, wherein said molten metal is poured at a rise rate of 0.5–1.8 cm/sec.

6. A method as claimed in claim 1, wherein said intermediate product is formed at a total reduction ratio (thickness of ingot/thickness of intermediate product) of not less than 1.5.

7. A method as claimed in claim 1, wherein the poured molten metal has a different composition from that of said core material.

* * * * *